US006299435B1

(12) United States Patent
Freeman et al.

(10) Patent No.: US 6,299,435 B1
(45) **Date of Patent: *Oct. 9, 2001**

(54) DECORATIVE CANDLE DISPLAY AND METHOD OF FORMATION

(76) Inventors: Faith Freeman, 3632 Rebel Cir., Huntington Beach, CA (US) 92653; Frank Asbury, 144 N. Trevor St., Anaheim, CA (US) 92806

( * ) Notice: Subject to any disclaimer, the term of this patent is extended or adjusted under 35 U.S.C. 154(b) by 0 days.

This patent is subject to a terminal disclaimer.

(21) Appl. No.: 09/767,211

(22) Filed: Jan. 22, 2001

Related U.S. Application Data

(63) Continuation of application No. 09/612,782, filed on Jul. 10, 2000.

(51) Int. Cl.[7] ..... F23D 13/16

(52) U.S. Cl. ..... 431/291; 431/126; 362/161; 44/275

(58) Field of Search ..... 431/289, 291, 431/288, 126; 362/161, 810; 264/271.1, 279.1, 275, 274; 425/803; 44/275, 265

(56) References Cited

U.S. PATENT DOCUMENTS 3,983,677 * 10/1976 Lundbom ..... 425/803
4,225,552 * 9/1980 Chang ..... 431/288
4,826,428 * 5/1989 Lam ..... 431/291
5,395,233 * 3/1995 Karp ..... 431/289
5,697,694 * 12/1997 Cutts ..... 362/161
5,879,694 * 3/1999 Morrison et al. ..... 431/288
6,210,153 * 4/2001 Freeman et al. ..... 431/291

* cited by examiner

*Primary Examiner*—Ira S. Lazarus
*Assistant Examiner*—Josiah C. Cocks
(74) *Attorney, Agent, or Firm*—Stetina Brunda Garred & Brucker

(57) ABSTRACT

A decorative candle display including a transparent container with an interior wall surface having disposed thereon a transparent combustible gelatinous liner. Situated on the liner is at least one shaped generally opaque structure fabricated of an opaque combustible wax material and a transparent combustible gelatinous material. An opaque combustible filler material is disposed within the container interiorly from the liner and visible therethrough, and a wick extends exteriorly from the filler material. Glitter particulate can be included in the liner to enhance glisten, while pigment and/or fragrance can be incorporated within the gelatinous and/or filler materials. The candle display is formed by coating a heat-melted transparent combustible gelatinous material onto the interior wall of the container, cooling and solidifying it to form a gelatinous liner, positioning the at least one opaque structure onto the liner, pouring a heat-melted opaque combustible filler material into the container interiorly of the liner and surrounding a previously placed wick, and finally cooling and solidifying the filler material to thereby complete the candle display.

12 Claims, 2 Drawing Sheets

DECORATIVE CANDLE DISPLAY AND METHOD OF FORMATION

CROSS-REFERENCE TO RELATED APPLICATIONS

This application is a continuation of co-pending U.S. patent application Ser. No. 09/612,782, filed Jul. 10, 2000.

(Not Applicable)

STATEMENT RE: FEDERALLY SPONSORED RESEARCH/DEVELOPMENT (Not Applicable)

BACKGROUND OF THE INVENTION

The present invention relates in general to decorative candles, and in particular to and in particular to a decorative candle display including a transparent container with a transparent combustible gelatinous liner disposed on the interior wall of the container, shaped generally opaque structures disposed against the gelatinous liner and fabricated of an opaque combustible wax material plus a transparent combustible gelatinous material, and a wicked and opaque combustible filler material disposed within the container interiorly from the liner.

Candles have become very popular for decorative purposes, and as such are produced in different styles, shapes, and colors, with one particular decorative presentment found in candle displays incorporating transparent containers in which candle products are housed for viewing. Such candle products typically are formed of an opaque wax material such as paraffin or of a transparent gelatin material such as a mineral oil gel, with a pigment and/or a fragrance optionally included within either material. Additionally, as shown in Applicant's U.S. Pat. No. 6,033,210, issued Mar. 7, 2000, a candle display is provided where transparent combustible gelatinous shaped structures are situated directly against an interior wall of a transparent container which is filled with an opaque combustible filler material that maintains the shaped structures against the interior wall for external visibility.

While the above-described display that includes opaque filler material plus discrete gelatinous structures permits some visual appreciability of gel, the gel presence at the container wall is restricted, and any interaction of glistening gel surface with opaque filler surface along with gel structures does not occur. Consequently, a primary object of the present invention is to provide a decorative candle display wherein a gelatinous liner is coated on the interior of a transparent container such that the opaque filler glistens.

Another object of the present invention is to provide a decorative candle display wherein shaped generally opaque structures fabricated of an opaque combustible wax material and a transparent combustible gelatinous material are disposed and retained against the gelatinous liner through adhesive interaction of interfacing gelatinous materials.

Yet another object of the present invention is to provide a method for producing a decorative candle display as defined above wherein gelatinous material appearance is further enhanced through incorporation of glitter particulate disbursed throughout the gelatinous liner.

These and other objects of the present invention will become apparent throughout the description thereof which now follows.

BRIEF SUMMARY OF THE INVENTION

The present invention is a decorative candle display first including a transparent container with an open top and an interior wall surface having disposed thereon a transparent combustible gelatinous liner. Situated on the liner is at least one shaped generally opaque structure fabricated of an opaque combustible wax material and a transparent combustible gelatinous material. An opaque combustible filler material is disposed within the container interiorly from the liner and visible therethrough, and a wick extends exteriorly from the filler material. Glitter particulate can be included in the liner to enhance glisten, while pigment and/or fragrance can be incorporated within the gelatinous and/or filler materials.

The candle display is formed by first heating a transparent combustible gelatinous material to its melting temperature, coating the melted gelatinous material onto entire interior surfaces of entire walls of a transparent container, and thereafter permitting the gelatinous material to cool and solidify as a gelatinous liner on the surface. Next, at least one shaped, generally opaque structure fabricated of an opaque, preferably pigmented, combustible wax material and a transparent combustible gelatinous material is disposed on the gelatinous liner. Finally, an opaque combustible filler material with or without pigment and/or fragrance is heated to its melting temperature, which is less than the melting temperature of the gelatinous material, and poured into the container interiorly of the gelatinous liner and surrounding a previously placed wick. The filler material then cools and solidifies, and construction of the candle display is thus completed.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 3:
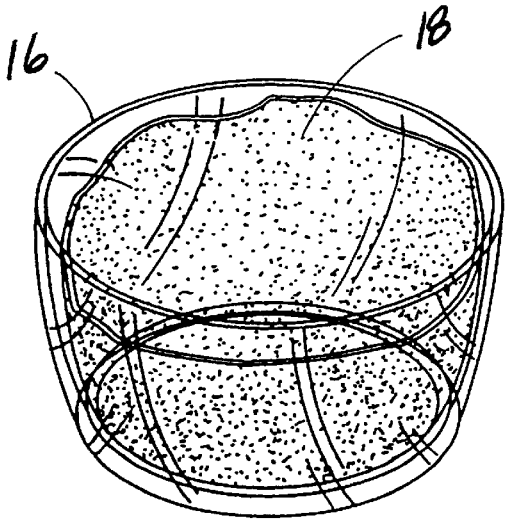

Referring to FIGS. 1–5, a decorative candle display 10 is shown. The candle display 10 is formed by heating a transparent combustible gelatinous material 12, preferably a mineral oil gel, having a plurality of glitter particles 14 disbursed therein, to its melting temperature and pouring it into a transparent container 16. While still in its molten state, the gelatinous material 12 is spread upon the interior walls of the container 16 by hand-rotating the container 16 to thereby coat the walls as a gelatinous material liner 18. Once so coated, any excess of gelatinous material 12 is poured from the container 16 and the gelatinous material 12 is cooled to solidify as a gelatinous liner 18 as illustrated in FIG. 3.

Figure 4:
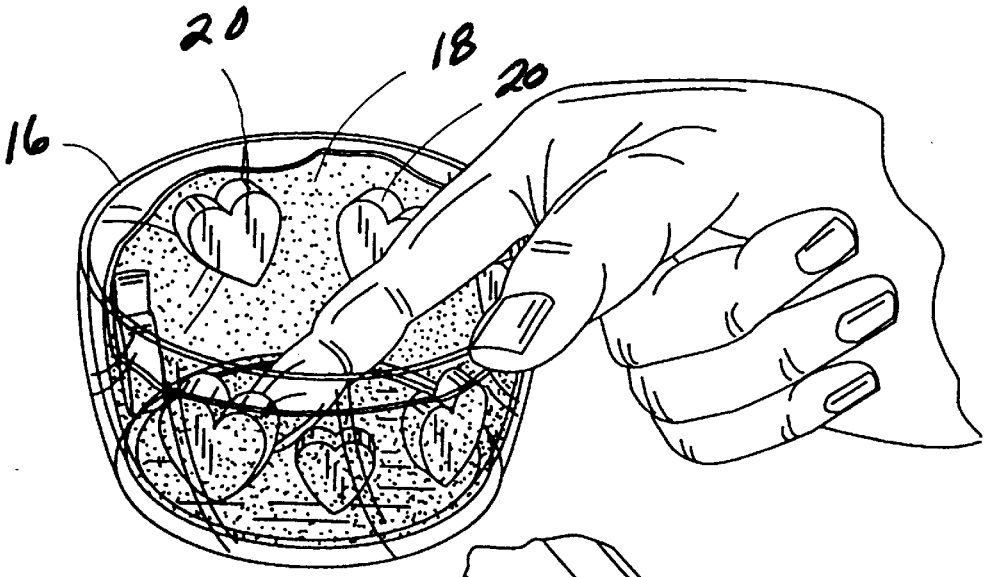

After the liner 18 is formed, at least one, and preferably a plurality of, shaped generally opaque structure 20, as exemplified in the drawings as a heart shape, is positioned there against by hand as illustrated in FIG. 4 for observability through the transparent container 12 and liner 18. The structure 20 is fabricated of an opaque combustible wax material and a transparent combustible gelatinous material preferably prepared in one of two ways. One such preparation is simply heating the wax material and the gelatinous material to their respective melting temperatures and mixing the two materials preferably along with a pigment. The resulting mixture is allowed to cool into a solid sheet configuration and the structure 20 is cut therefrom in cookie-cutter fashion. The second such preparation first heats the gelatinous material to its melting temperature and then pours it into a sheet configuration for cooling and solidification. Thereafter, the wax material is heated to its melting temperature, which is less than the melting temperature of the gelatinous material, and poured over the gelatinous material sheet to thereby form, upon cooling of the wax material, a two layer sheet of wax material and gelatinous material from which the structure 20 is likewise cut therefrom in cookie-cutter fashion. Under either preparation, because of the presence of the wax material, the structure 20 cuts cleanly and retains its edges crisply. The liner 18 retains the structure 20 because of inherent adherence of gelatinous material to gelatinous material. Either side of a structure 20 prepared as a mixture of gelatinous and wax materials can be held by the liner 18 due to the presence of gelatinous material throughout the mixture. Conversely, in a structure 20 prepared as layers, only the gelatinous layer thereof is retained by the liner 18. In either event, however, the structure 20 stays on the liner 18 without pressure there against.

Figure 1:
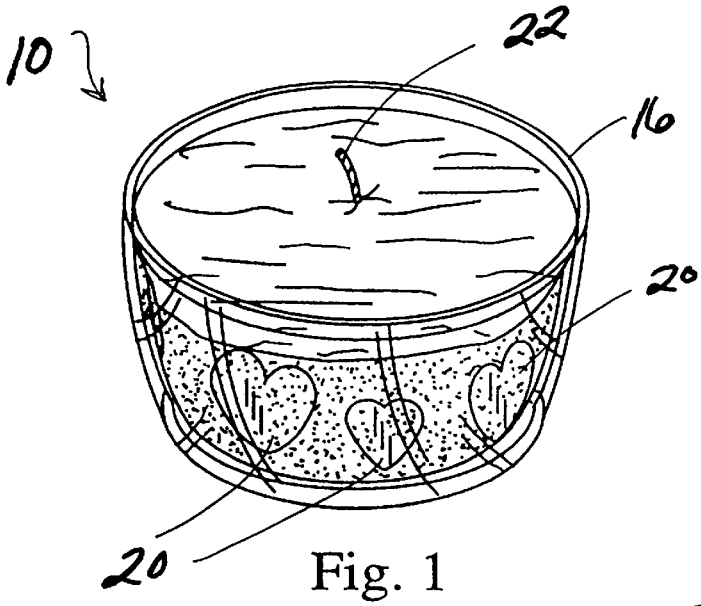
FIG. 1 is a perspective view of a decorative candle display.
Figure 2:
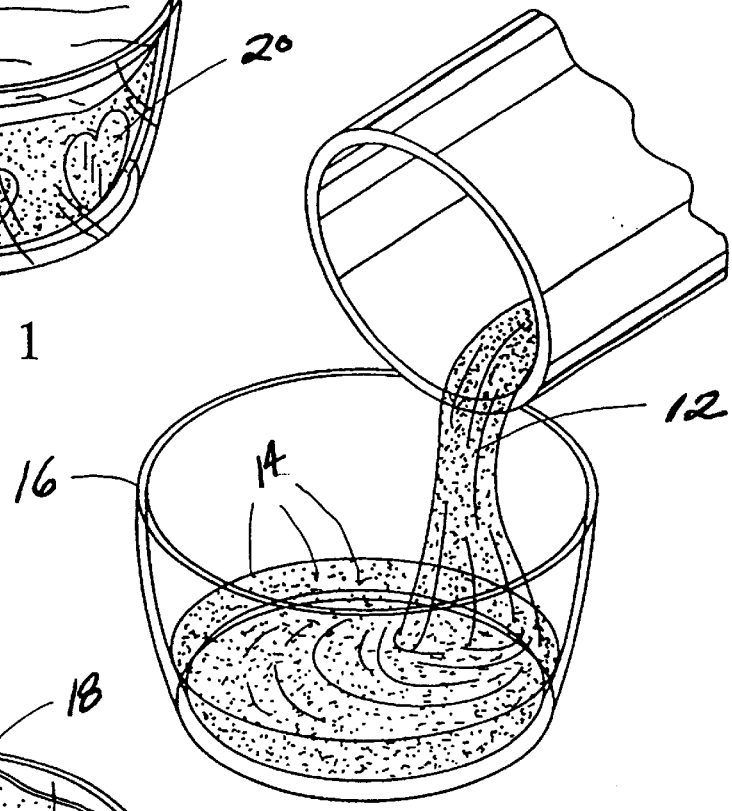
FIGS. 2–5 are perspective views of fabrication steps of the decorative candle display of FIG. 1.
Figure 5:
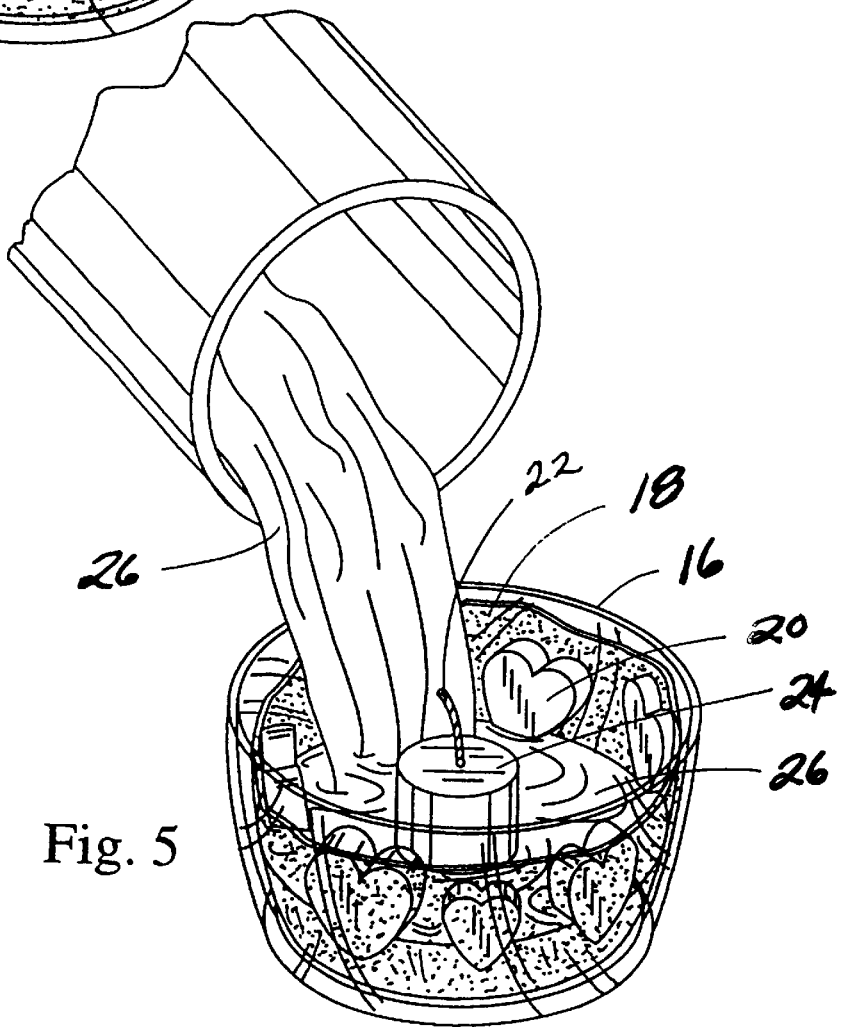

As shown in FIGS. 1 and 5, a wick 22 is provided. One expedient manner in which the wick 22 can be supplied is by placing a standard votive-type candle 24 in the container 12, as shown in FIG. 5, and thereafter filling the container 12 with a combustible filler material 26 which preferably is paraffin. Pourable preparation is accomplished by heating an opaque combustible filler material 26 to its melting temperature, which is less than the melting temperature of the gelatinous material, and pouring it into the container 12 interiorly of the gelatinous liner 18 and surrounding the candle 24 and thus the wick 22. The filler material 26 is thereafter cooled to solidification, and the decorative candle display 10 is completed. Because of the interiorly coated gelatinous liner 18, which is not apparent as a separate component in the finished display 10, the shaped generally opaque structures 20 and the filler material 26 visible through the transparent container 12 appear exceptionally lustrous, while the preferably included glitter particles 14 function to impart an aesthetically pleasing unique presentation.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A decorative candle display comprising:

a) a transparent container with an interior wall surface;

b) a transparent gelatinous liner disposed on said interior wall surface;

c) at least one shaped generally opaque structure disposed against the gelatinous liner and fabricated of an opaque wax material and a transparent gelatinous material;

d) an opaque filler material disposed within the container interiorly from the liner; and e) a wick extending from the filler material.

2. A decorative candle display as claimed in claim 1 wherein the gelatinous liner has generally uniformly disbursed therein a plurality of glitter particles.

3. A decorative candle display as claimed in claim 1 wherein the gelatinous liner has generally uniformly disbursed therein a pigment.

4. A decorative candle display as claimed in claim 1 wherein the gelatinous liner is a mineral oil gel.

5. A decorative candle display as claimed in claim 1 wherein in the at least one shaped generally opaque structure the combustible wax material is a first layer and the gelatinous material is a second layer atop the first layer, with said second layer disposed against the gelatinous liner.

6. A decorative candle display as claimed in claim 5 wherein the wax material has generally uniformly disbursed therein a pigment.

7. A decorative candle display as claimed in claim 1 wherein in the at least one shaped generally opaque structure said structure is fabricated of a mixture of the combustible wax material and the gelatinous material.

8. A decorative candle display as claimed in claim 7 wherein the mixture has generally uniformly disbursed therein a pigment.

9. A decorative candle display as claimed in claim 1 wherein the opaque combustible filler material is a wax material.

10. A decorative candle display as claimed in claim 1 wherein the filler material has generally uniformly disbursed therein a pigment.

11. A decorative candle display as claimed in claim 1 wherein the filler material has therein a fragrance.

12. A decorative candle display as claimed in claim 1 wherein the wick is anchored in a core candle structure surrounded by the filler material.

* * * * *